US005285900A

United States Patent [19]

Swingler

[11] Patent Number: 5,285,900

[45] Date of Patent: Feb. 15, 1994

[54] STACKABLE STORAGE CONTAINERS

[76] Inventor: Sheni S. Swingler, 6105 W. Columbia Ave., Philadelphia, Pa. 19151

[21] Appl. No.: 48,023

[22] Filed: Apr. 15, 1993

[51] Int. Cl.[5] ..... B65D 41/16; B65D 43/10

[52] U.S. Cl. ..... 206/508; 206/425; 220/676

[58] Field of Search ..... 206/508, 509, 555, 425; 220/661, 676

[56] References Cited

U.S. PATENT DOCUMENTS

| | | | |
|---|---|---|---|
| 3,635,361 | 1/1972 | Hayes | 214/10.5 R |
| 4,247,004 | 1/1981 | Bird | 206/506 |
| 4,373,642 | 2/1983 | Wolters et al. | 220/72 |
| 4,450,960 | 5/1984 | Johnson | 206/508 |
| 4,478,344 | 10/1984 | Rehrig | 220/676 |
| 4,523,692 | 6/1985 | Lemkin | 220/508 |
| 4,819,822 | 4/1989 | Box | 220/676 |
| 4,917,255 | 4/1990 | Foy et al. | 220/4 |

*Primary Examiner*—Joseph Man-Fu Moy
*Attorney, Agent, or Firm*—Seidel, Gonda, Lavorgna & Monaco

[57] ABSTRACT

A stackable storage container for storing articles has a box having a bottom, a pair of opposed side walls, and a pair of opposed end walls. The walls extend up from the bottom to a free edge, and the opposed walls angle away from each other as they extend from the bottom towards the free edge. The bottom and the walls define a storage space for articles. The free edge defines an opening for access to the storage space. A cover has a top and a downwardly depending lip for engaging the walls adjacent to the free edge for releasably retaining the cover on the box and an upward projecting rim for engaging the walls of a second box adjacent its bottom for releasably retaining the second box on the cover. One of the end walls has a cut-out therein opening onto the free edge. A ledge bordering the cut-out and projecting outboard has a track for receiving and retaining a movable insert panel there for selectably opening and closing the cut-out. The track being arranged so that the panel when inserted into the track is at an angle to the end wall having the cut-out such that the upper region of the panel extends further from the wall than the lower region of the panel.

20 Claims, 3 Drawing Sheets

FIG. 3
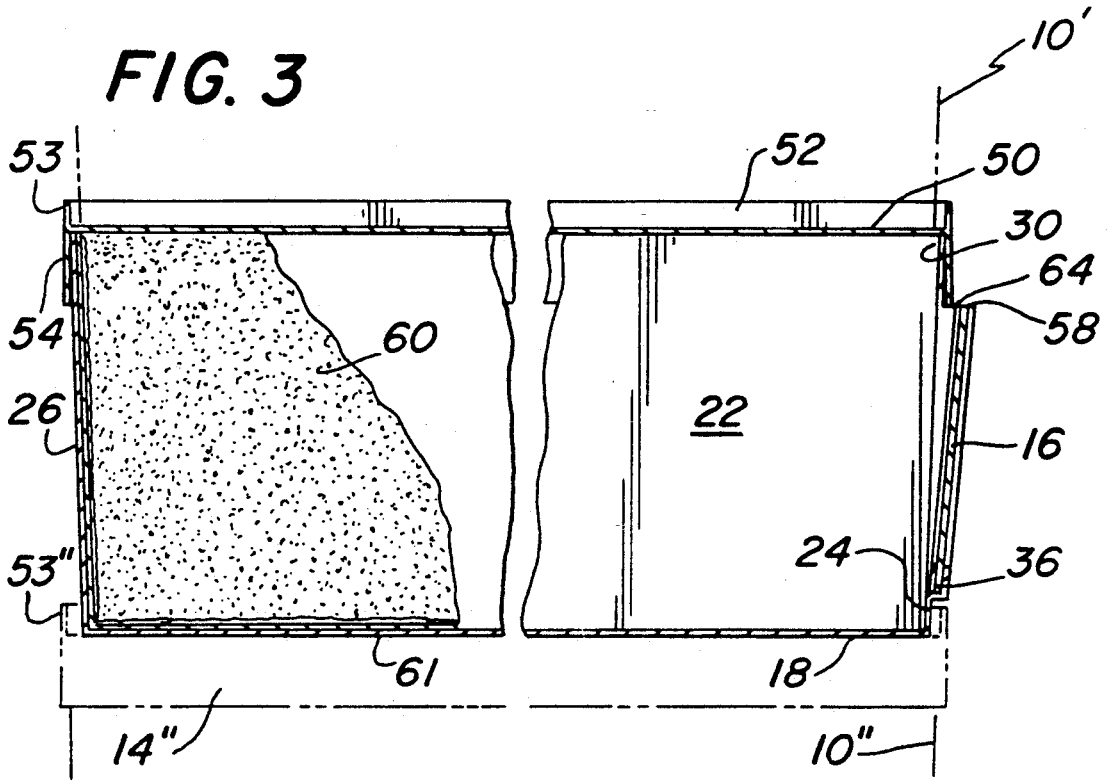
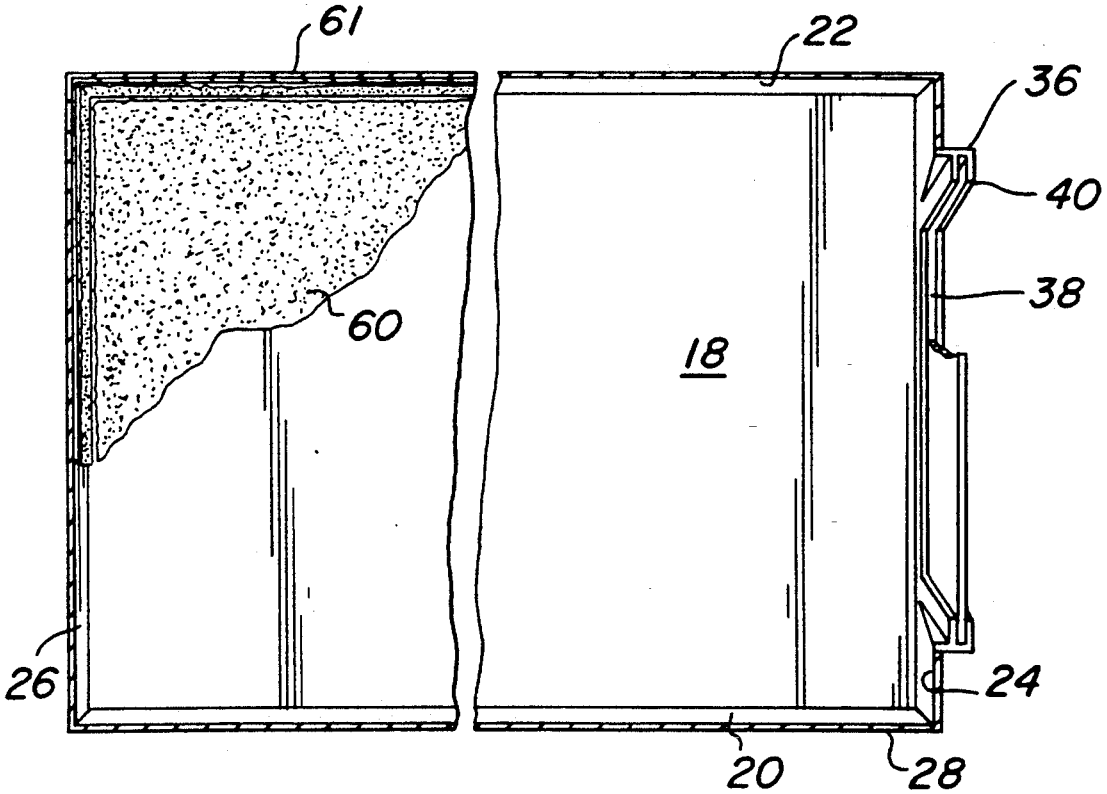
FIG. 4

STACKABLE STORAGE CONTAINERS

FIELD OF THE INVENTION

This invention relates to a stackable storage container for the storage of articles and more particularly to a container shaped for easy stacking and having a removable panel for granting access to the storage area in the box when the cover is on and there are other containers stacked on top of the container to which access is desired.

BACKGROUND OF THE INVENTION

It is common to store articles not currently being used in containers, whether merchandise in a store or shoes at home. However, it is a common problem finding locations to store these containers and it is unusual to have the opportunity to have only one level on the floor or shelf; therefore the person is typically required to stack these containers upon one another to store them. In fact it is quite common to stack containers located in storage rooms or closets. Ideally, all the storage containers being used are rectangular and of the same size, thereby allowing relatively easy stacking. However, difficulty occurs when the stack of containers reaches a height and are not prefectly placed on top of each other such that the stack begins to lean and becomes unstable.

In addition, with the stack of containers it is difficult to determine what is in a lower container and remove the contents without unstacking all of the containers and then re-stacking them afterwards. In addition, the constant unstacking and stacking of the containers tends to result in the person not stacking the containers as neatly as possible and therein inducing the likelihood of the stack being unstable and leaning.

It would be desirable to have a stackable storage container wherein the shape of the container lends itself to sturdy stable stacking and allows access to the storage area in lower containers.

SUMMARY OF THE INVENTION

This invention is directed to a stackable storage container for storing articles. A box has a bottom, a pair of opposed side walls, and a pair of opposed end walls. The walls extend up from the bottom to a free edge, and the opposed walls angle away from each other as they extend from the bottom towards the free edge. The bottom and the walls defines a storage space for articles. The free edge defines an opening for access to the storage space. A cover has a top and a downwardly depending lip for engaging the walls adjacent the free edge for releasably retaining the cover on the box and an upward projecting rim for engaging the walls of a second box adjacent to its bottom for releasably retaining the second box on the cover. One of the end walls has a cut-out therein opening onto the free edge. A ledge bordering the cut-out and projecting outboard has a track for receiving and retaining a movable insert panel there for selectably opening and closing the cut-out. The track is arranged so that the panel when inserted into the track is at an angle to the end wall having the cut-out such that the upper region of the panel extends further from the wall than the lower region of the panel.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3 is a view of the stackable container taken along the lines 3—3 of FIG. 1. A portion of a stackable storage container both above and below are shown in phantom;

FIG. 4 is a view of the stackable storage container taken along the lines 4—4 of FIG. 1;

DETAILED DESCRIPTION OF THE PREFERRED EMBODIMENTS

Figure 1:
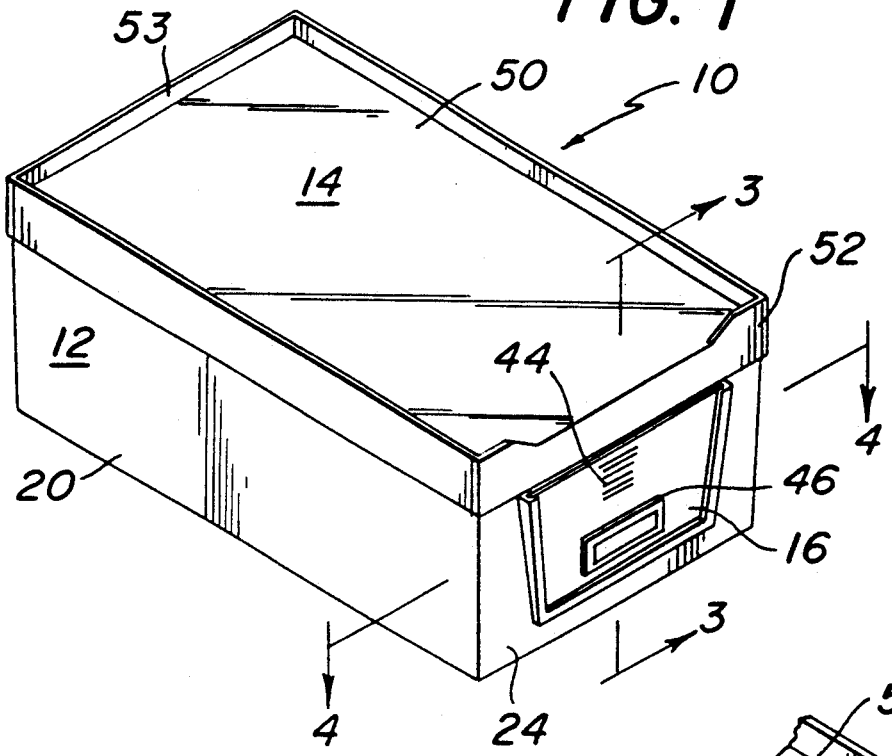
FIG. 1 is a perspective view of the stackable storage container of the present invention.
Figure 2:
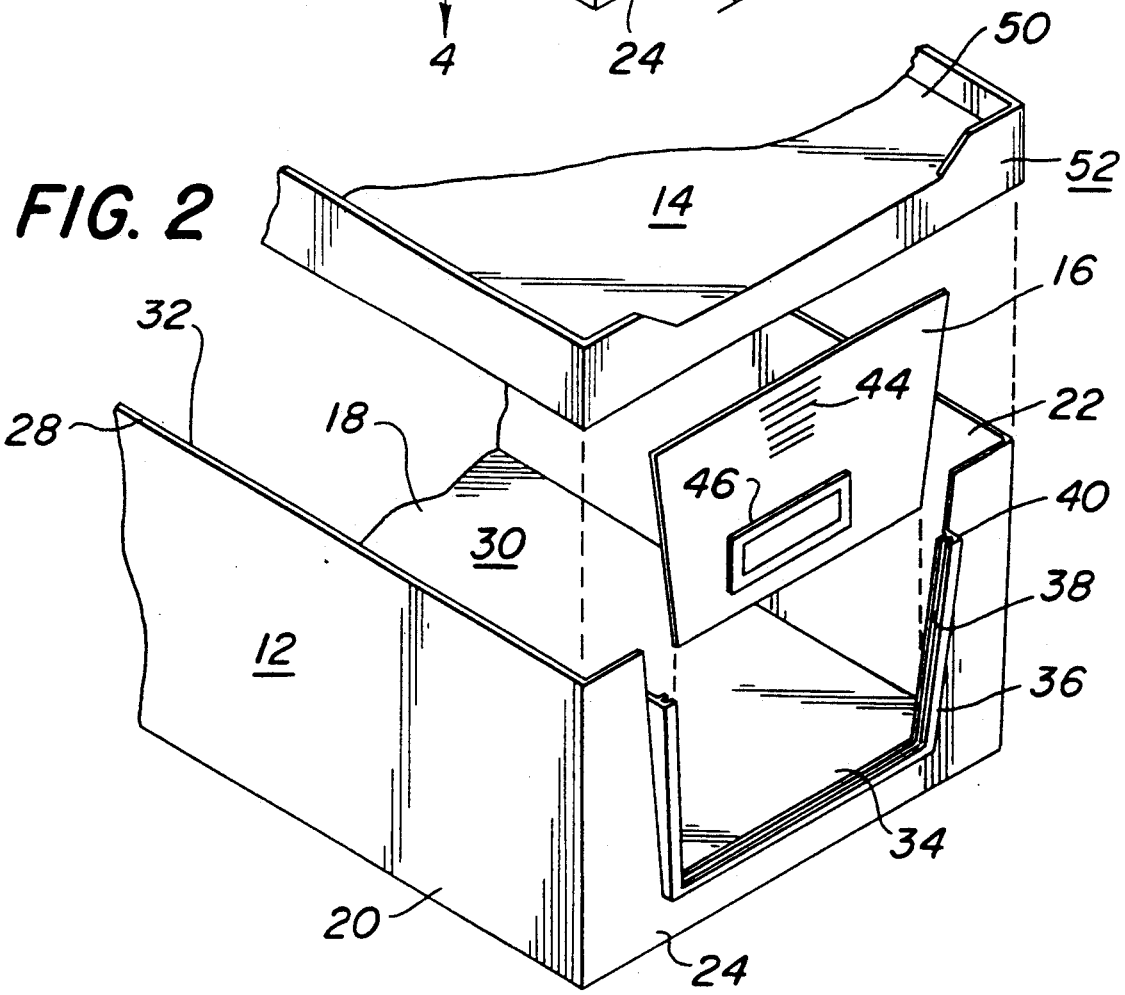
FIG. 2 is an exploded view showing a portion of the container of FIG. 1.

Referring now to the drawings, wherein like numerals indicate like elements and where primes (′ or ″) indicate counterparts of such like elements, there is shown in FIG. 1 a perspective view of a stackable storage container which has been identified by the numeral 10. Referring to FIGS. 1 and 2, the container 10 has a box 12, a cover 14 and a movable insert panel 16. The box 12 has a bottom 18 and a pair of side walls 20, 22 and a pair of end walls 24 and 26 (end wall 26 is shown in FIGS. 3 and 4). The walls 20, 22, 24 and 26 extend upwardly from the bottom 18 to a free edge 28. The walls of the box 12 define a storage area 30 for articles. Storage area 30 has an opening 32 defined by the free edge 28.

A cut-out 34 is located on the end wall 24 which opens onto the free edge 28. The cut-out 34 grants access to the storage area 30 and is bounded on three sides by a ledge 36 mounted to the end wall 24. The cut-out 34 is of such a size that an individual can determine what is in the storage area 30 even when the cover 14 is on the box 12 by observing through the cut-out 34. Most articles, such as a pair of shoes (not shown), may be removed or inserted through the cut-out 34.

The ledge 36 angles away from the end wall 24 and outward from the storage area 30 as it projects upward from the bottom 18 towards the free edge 28. The ledge 36 has a track 38 defined by a pair of rails 40 for receiving and retaining the insert panel 16 and guiding the panel 16 between an insert position covering the cut-out and a removed position. The track 38 is tapered similarly to the insert panel 16 to facilitate the ease of installing the panel 16.

The insert panel 16 has a series of ribs 44 projecting from it to facilitate gripping the insert panel 16 for moving from the cut-out covering position. In addition, the insert panel 16 has a frame 46 for receiving a label on which to indicate the contents of the storage area 30 of the container 10.

The cover 14 has a top 50 and a flange 52 which encircles the top. Referring to FIGS. 3 and 4, the flange 52 has both an upward projecting rim 53 and a downward projecting lip 54 so as to define two receiving areas. As seen in FIG. 3, the top 50 of the cover 14 engages the free edge 28 of the box 12 with the downward depending lip 54 located outside of the box 12 snugly engaging the walls 20, 22, 24 and 26, retaining the cover 14 on the box 12 and preventing relative movement. The cover 14 is removable by simply lifting.

It can be seen FIG. 3 that the walls 20, 22, 24 and 26 angle outward as they extend up from the bottom 18 towards the free edge 28 such that the opposed walls (i.e. sidewall 20 and 24 and end walls 22 and 26) are farther apart at the free edge 28 than at the bottom 18. The opening 32 therein is larger than the bottom 18. Referring to FIG. 3, two other containers 10' and 10" are shown in phantom stacked with the container 10. The bottom 18' of the container 10' is received within the rim 53 of the cover 14. The bottom 18 of the container 10 is received in the rim 53" of the cover 14" rim 53' of the lower container, alignment is insured and the likelihood of toppling is diminished. A gap 55 (FIG. 1) in the rim 53 allows access to the bottom 18' of the container 10' to aid removal of the upper container 10' and to receive the lower portion of the ledge 36.

As can be seen in FIG. 3, the insert panel 16 which is received in track 38 of ledge 36, angles outward from end wall 24 so that the upper edge 58 of the insert panel 16 is outward of the lip 52 of the cover 14. The insert panel 16 may be removed even when other containers 10' are stacked on the container 10 to grant access to the storage area 30.

The storage area 30 of the box 12 may be lined to both cushion and protect the stored articles and to present a better backdrop if the box 12 is used to display merchandise. FIGS. 3 and 4 show a lining 60 attached by a simple adhesive 61. The lining is contemplated to be velvet or other similar material.

Figure 5:
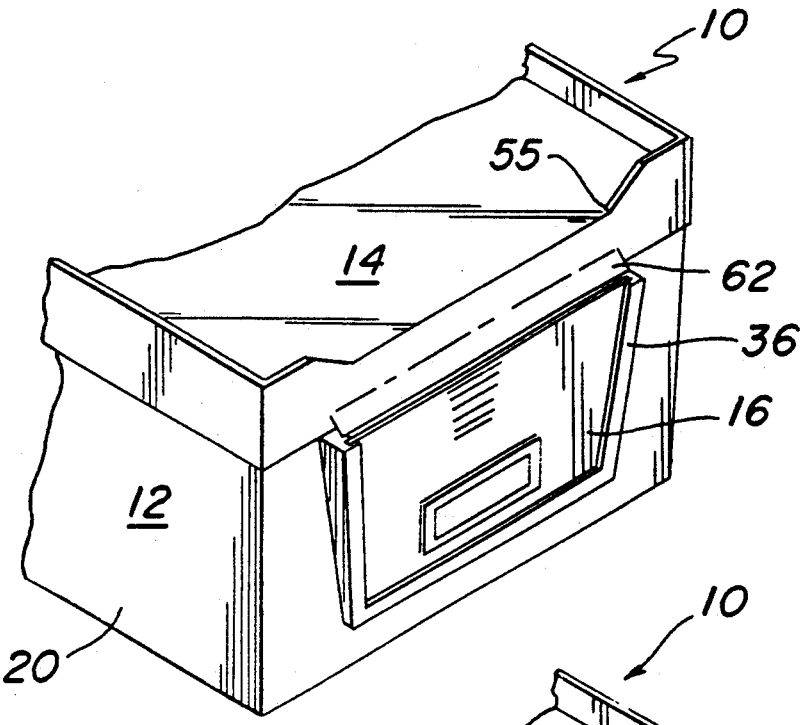
FIG. 5 is a perspective view showing a section of a second embodiment of the container of the present invention.

Referring to FIG. 5, a flexible dust cover 62 may be mounted on cover 14 to cover an opening 64 located between the upper edge 58 of the insert panel 16 and the lip 52 of the cover 14 (FIG. 3).

Figure 6:
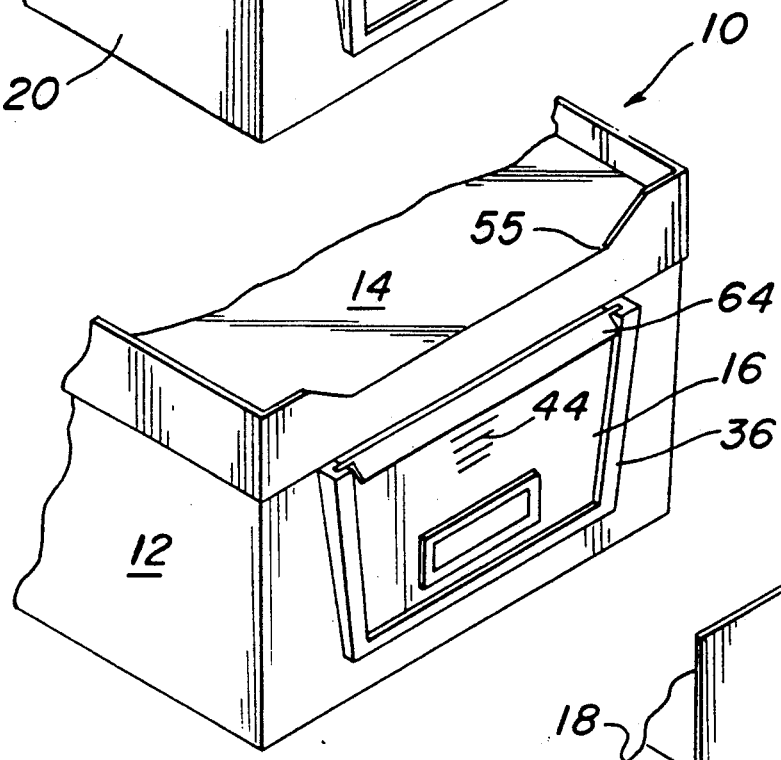
FIG. 6 is a perspective view showing a segment of another embodiment of the present invention.

FIG. 6 shows a second embodiment of a dust cover 66 wherein the dust cover is mounted to the upper edge 58 of the insert panel 16 such that the dust cover 66 in addition to covering the opening 64 may be used as another means of lifting the insert panel in addition to the ribs 44.

Figure 7:
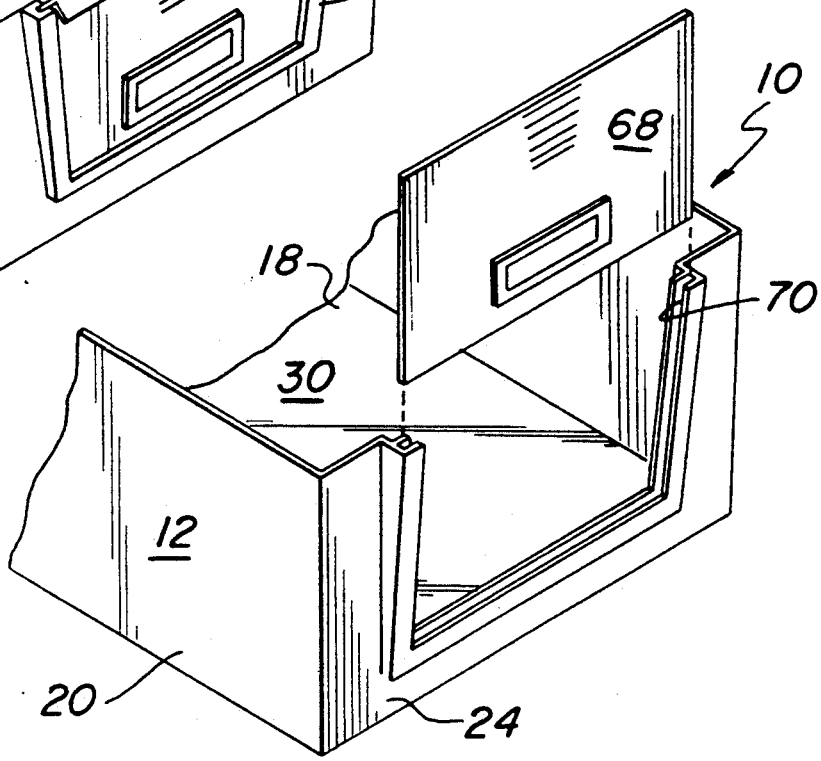
FIG. 7 is a perspective view showing an alternative embodiment of the ledge related to the present invention.

FIG. 7 shows an insert panel 68 which is rectangular in shape that is received in a track 70 which is also rectangular. The rectangular insert panel 16 and track 70 allow the insert panel to be slid upward while remaining in the track 70.

The present invention may be embodied in other specific forms without departing from the spirit or essential attributes therefore and, accordingly, references should be made to appended claims, rather than to the foregoing specification, as indicated in the scope of the invention.

I claim:

1. A stackable storage container for storing articles, comprising a box having a bottom and four walls extending upwardly from the bottom to a free edge, the bottom and the walls defining a storage space for articles and the free edge defining an opening for access to the storage space, a cover having a top and a downwardly depending lip for engaging the side walls adjacent the free edge for releasably retaining the cover on the box, one of the walls having a cut-out therein, and guide means bordering the cut-out for receiving and retaining a movable panel therein for selectably opening and closing the cut-out, the panel being approximately the same size as the cut-out, the guide means being arranged so that the panel when inserted into the guide means is at an angle to the wall having the cut-out such that the upper region of the panel extends further from the wall than the lower region of the panel.

2. The stackable storage container of claim 1 wherein the cut-out of the wall opens onto the free edge.

3. The stackable storage container as in claim 1 wherein the walls angle away from the opposed wall as they extend upward from the bottom towards the free edge.

4. The stackable storage container as in claim 1 wherein the cover has an upward projecting rim for engaging the walls of a second box adjacent to a bottom for releasably retaining the second box on the cover.

5. A stackable storage container for storing articles, comprising a box having a bottom and four walls extending upwardly from the bottom to a free edge, the walls angling away from the opposed wall as they extend from the bottom towards the free edge, and the bottom and the walls defining a storage space for articles and the free edge defining an opening for access to the storage space, a cover having a top and a downwardly depending lip for engaging the walls adjacent the free edge for releasably retaining the cover on the box, one of the walls having a cut-out therein opening onto the free edge, and a guide mens bordering the cut-out for receiving and retaining a movable insert panel therein for selectably opening and closing the cut-out, the panel being approximately the same size as the cut-out, the guide means being arranged so that the panel when inserted into the guide means is at an angle to the wall having the cut-out such that the upper region of the panel extends further from the wall than the lower region of the panel for covering the cut-out and angled outward as extending toward the upper edge for spacing the upper edge of the panel outward of the cover.

6. The stackable storage container as in claim 5 wherein the cover has an upward projecting rim for engaging the walls of a second box adjacent a bottom for releasably retaining the second box on the cover.

7. A stackable storage container for storing articles, comprising a box having a bottom, a pair of opposed side walls, and a pair of opposed end walls, each wall extending upwardly from the bottom to a free edge, and the opposed walls angling away from each other as they extend from the bottom towards the free edge, the bottom and the walls defining a storage space for articles and the free edge defining an opening for access to the storage space, a cover having a top and downwardly depending lip for engaging the walls adjacent to the free edge for releasably retaining the cover on the box, one of the end walls having a cut-out therein opening onto the free edge, and a ledge bordering the cut-out projecting outboard and having a track for receiving and retaining a movable insert panel there for selectably opening and closing the cut-out, the track being arranged so that the panel when inserted into the track is at an angle to the end wall having the cut-out such that the upper region of the panel extends further from the wall than the lower region of the panel.

8. A stackable storage container as in claim 7 wherein the cover has an upward projecting rim for engaging the walls of a second box adjacent to a bottom for releasably retaining the second box on the cover.

9. A stackable storage container as in claim 8 wherein the walls of the second box engage the rim of the cover providing interlocking when one stackable storage container is stacked upon another stackable storage container.

10. A stackable storage container as in claim 7 wherein the cut-out provides a sufficient opening for removal of articles from the storage area.

11. A stackable storage container as in claim 7 wherein a dust cover overlies the cut-out opening.

12. A stackable storage container as in claim 11 wherein the dust cover depends from the cover.

13. A stackable storage container as in claim 11 wherein the dust cover is carried by the panel.

14. A stackable storage container as in claim 7 wherein the insert panel is a trapezoid tapering down from the upper edge and the track of the ledge has a complimentary shape.

15. A stackable storage container as in claim 7 wherein the panel has a plurality of ribs for facilitating movement of the panel between the cut-out covering position and removed position.

16. A stackable storage container as in claim 15 wherein the panel has a label holder.

17. A stackable storage container as in claim 7 wherein the box and the cover are made of cardboard.

18. A stackable storage container as in claim 7 wherein the box, panel and cover are made of a transparent material.

19. A stackable storage container as in claim 17 wherein the box has a cloth material covering the bottom and walls.

20. A stackable storage container as in claim 19 wherein the material is velvet.

* * * * *